US006467128B1

(12) United States Patent
Damani

(10) Patent No.: US 6,467,128 B1
(45) Date of Patent: Oct. 22, 2002

(54) BLOCK AND TACKLE SASH COUNTER BALANCE

(75) Inventor: Manish Damani, Rochester, NY (US)

(73) Assignee: DEAL International Inc., Rochester, NY (US)

( * ) Notice: Subject to any disclaimer, the term of this patent is extended or adjusted under 35 U.S.C. 154(b) by 10 days.

(21) Appl. No.: 09/659,824

(22) Filed: Sep. 11, 2000

(51) Int. Cl.[7] ..... E05F 1/00

(52) U.S. Cl. ..... 16/197; 16/193; 49/445; 49/446; 49/447

(58) Field of Search ..... 16/197, 196, 193, 16/212, 213, 210, 400, 445, 446, 447, 414, 453, 463

(56) References Cited

U.S. PATENT DOCUMENTS

| | | | | | |
|---|---|---|---|---|---|
| 4,078,336 | A | * | 3/1978 | Prosser | 49/445 |
| 4,089,085 | A | | 5/1978 | Fitzaibbon | |
| 4,190,930 | A | * | 3/1980 | Prosser | 49/445 |
| 4,332,054 | A | * | 6/1982 | Paist et al. | 16/197 |
| 4,760,622 | A | * | 8/1988 | Rohrman | 16/196 |
| 4,763,447 | A | * | 8/1988 | Haltof et al. | 49/445 |
| 4,811,455 | A | | 3/1989 | Ost et al. | |
| 4,949,425 | A | | 8/1990 | Dodson et al. | |
| 5,737,877 | A | * | 4/1998 | Meunier et al. | 16/197 |
| 5,873,199 | A | * | 2/1999 | Meunier et al. | 49/445 |

OTHER PUBLICATIONS

700 Series Tilt System for Single/Double Hung Windows; Balance Systems, Inc. brochure; 1992; 6 pages (page numbers unknown); Sioux Falls, SD (USA).

* cited by examiner

*Primary Examiner*—Chuck Y. Mah
(74) *Attorney, Agent, or Firm*—Greenwald & Basch LLP; Duane C. Basch

(57) ABSTRACT

The present invention is an apparatus and method of assembling a block and tackle counter balance for windows that reduces the cost of manufacture and installation. In particular, the balance provides vertical support to a window sash using a semi-rigid channel, a top shoe for insertion into one end of the semi-rigid channel, and a bottom shoe for insertion into another end of the semi-rigid channel. Connected to the top shoe is a spring, and a block and tackle pulley assembly is connected between the bottom end of the spring and the bottom shoe, wherein a cord from the pulley assembly extends outward from the bottom shoe for connection to the window sash.

26 Claims, 7 Drawing Sheets

BLOCK AND TACKLE SASH COUNTER BALANCE

This invention relates generally to sash counter balances in windows, and more particularly to a block and tackle counter balance for windows that reduces the cost of manufacture and installation.

BACKGROUND AND SUMMARY OF THE INVENTION

Block and tackle counter balances have been in use in the window industry for many years. The block and tackle device is used to minimize the extension of a spring being used to counter the weight of the window sash. This allowed the balance to be put into a single compact unit.

Heretofore, a number of patents and publications have disclosed aspects of window counter-balances, the relevant portions of which may be briefly summarized as follows:

U.S. Pat. No. 4,089,085 to Fitzgibbon et. al., issued May 16, 1978, discloses the construction and components of a block and tackle sash counter balance.

U.S. Pat. No. 4,811,455 to Ost et al., issued Mar. 14, 1989, teaches a system of anchoring a window balance spring within a channel.

U.S. Pat. No. 4,949,425 to Dodson et al., issued Aug. 21, 1990, discloses the simplified construction of a. window sash balance assembly. The pre-assembled, unitary system includes a spring-loaded block and tackle enclosed within a channel having laterally spaced sidewalls.

Balance Systems, Inc. disclose, in a 1992 brochure, a "700 Series" block and tackle balance system. Each of said system configurations include a continuous U-shaped channel that encloses the block and tackle and spring assembly.

As depicted in prior art FIG. 13, these balances are typically constructed of a U-shaped rigid body or channel 1020 made of either aluminum or steel, which may be painted or unpainted. A lower pulley housing 1022 generally contains one or more lower pulleys 1024 riveted to the bottom of the rigid channel 1020 and retained within the housing. An upper pulley housing 1026 also contains one or more upper pulleys 1028, and is slidably attached to the lower end of a spring 1030. The upper end of the spring is attached to a rivet 1032 that is fixed at the upper end of the rigid channel 1020, so as to pass through both sides of the channel and to provide a location to which the spring 1030 may be attached (e.g., by a hook at the end of the spring). From the bottom of the channel extends string 1034 with a terminal clip 1036 attached thereto for releasable connection with a sash.

Such prior art balances maintain the spring at an initial tension, which requires that the U-shaped housing be made of a rigid material in such a way as to have significant resistance to a compressive force applied along a longitudinal axis of the channel, so as to avoid collapsing the balance while it is being installed and operated. Accordingly, the rigid U-shaped channel is expensive to manufacture as it requires tooling and equipment for bending the channel and machining it, and the use of a costly metal alloy such as steel or aluminum. For longer and higher weightcarrying counter balances the channel must be constructed of steel for strength. However, steel is subject to corrosion and has to be treated with a corrosion resistant coating (e.g., painted, galvanized). Furthermore, the lower pulley housing 1022 is riveted to the channel 1020, requiring a riveting step at the bottom as well as a rivet for the spring at the top. During manufacture, the riveting steps result in the addition of significant time for assembly, and add to the cost of each balance. The labor involved in the threading of the block and tackle is also very time consuming and can be up to one-third of the cost of the counter balance.

As mentioned earlier the spring (1030) used in the prior art balance is already in the initial stretched or pre-tensioned position when the balance is assembled. This is required to put the spring in its appropriate working range in order to operate the counter balance effectively for the range of weight and size of sash it was designed for. Pre-tensioning of the spring reduces its working range (distance) and does not allow for a use of the spring over its entire working range. Pre-tensioning also forces the length of the balance to be equivalent to that of the sash height, thereby forcing the design to have a longer balance than required for the working range of the sash. Lastly, pre-tensioning also forces the balances to be made in increments (e.g., 1 inch) so as to be able to closely match the sash heights. It also forces the window manufacturer to inventory all. the various size and weight carrying capacities of balances, which can be very expensive.

Finally when the balances are made of a metal such as aluminum alloy or steel, it is often necessary to place a decorative cover on the balances for aesthetic and/or functional reasons. The balance cover hides the balance and also allows for the tilt and turn latch to glide without hitting the balance and causing an obstruction. Alternatively, the balances are painted, adding cost on the part.

The present invention addresses a previously unappreciated need for a balance that (a) will have an aesthetically pleasing body, (b) does not corrode, (c) is lighter and more cost effective (material cost) than current materials used, and/or (d) is easier to assemble and therefore less costly to assemble. Furthermore, the present invention is intended to. reduce the manufacturing complexity of a balance by, for example, incorporating a design wherein the threading of the pulleys with string can be out-sourced to lower-cost companies or countries, and thereby reducing the labor cost of threading. In addition, an aspect of the present invention enables a single balance to be used for a plurality of window sash heights, thereby reducing the number of balances that must be stocked in inventory by the window manufacturers who construct and install windows.

It is, therefore, and object of the present invention to provide a counter balance with a channel that is non corroding, semi rigid and is not required to carry a compressive load or stress as found in prior art counter balance designs.

It is another object of the present invention to make, full-length, rigid channel unnecessary while providing equivalent functionality of traditional counter balances using block and tackle assembly.

It is yet another object of the present invention to provide a balance design that incorporates, or allows the incorporation of, a balance cover.

It is yet another object of the present invention to provide a balance design that incorporates, or allows the incorporation of, a second, parallel balance into one assembly so as to carry a heavier sash. Such a design also reduces the material and labor costs associated with the fabrication and installation of the balances and covers.

It is another object of this invention to make the assembly of the balance rivet-free to allow for high-speed assembly with minimal labor.

It is another object of this invention to make the pulley assembly modular, and thereby enabling the threading of the pulley with the cord to be done separately from the assembly of the balance, and reducing labor costs.

It is another object of this invention to use the complete working range of the spring. and allow a single balance to be used for a plurality of sash heights—thereby reducing the number of balance models needed to be maintained in inventory for a window manufacturer to make a complete set that can carry all the sizes and weights of window sashes required.

In accordance with the present invention, there is provided a balance assembly for providing vertical support to a window sash, comprising: a channel; a top shoe for insertion into one end of the semi-rigid channel; a bottom shoe for insertion into another end of the semi-rigid channel; a spring connected to a bottom end of the top shoe; and a block and tackle pulley assembly connected between a bottom end of the spring and the bottom shoe, wherein a cord from the pulley assembly extends outward from the bottom shoe for connection to the window sash.

In accordance with another aspect of the present invention, there is provided a balance assembly for providing vertical support to a window sash, comprising: a top shoe; a bottom shoe; a spring connected to a bottom end of the top shoe; a block and tackle pulley assembly connected between a bottom end of the spring and the bottom shoe, wherein a cord from the pulley assembly extends outward from the bottom shoe for connection to the window sash; and a balance cover, removably attached to said top and bottom shoes to provide a cover for the spring and pulley assembly.

In accordance with yet another aspect of the present invention, there is provided a method for installing a balance assembly on a window frame or a jamb liner to provide vertical support to a window sash, comprising: connecting, in series, a top shoe, a spring connected to a bottom end of the top shoe, a block and tackle pulley assembly connected to a bottom end of the spring, and a bottom shoe that retains a bottom pulley of the block and tackle pulley assembly, wherein a cord from the pulley assembly extends downward from the bottom shoe for connection to the window sash; affixing the top shoe to the window frame; affixing the bottom shoe to the window frame at a position below the top'shoe, wherein the spring is placed in tension; and placing a cover over the balance assembly, wherein the cover is attached to the top and bottom shoes.

The present invention. provides a simple construction, assembly. and installation method that addresses all the aforementioned problems that are inherent in the prior art block and tackle counter balance. In particular the U-shape channel is changed from a rigid metal part to a semi-rigid vinyl channel that is easily extruded and costs a fraction of the metal channel. An extruded vinyl part produced in accordance with an aspect of the present invention has the advantage of being less expensive, corrosion resistant and esthetically pleasing as it can be extruded in various colors to match any wood, metal or vinyl profile. Further a simple addition of an extension on the top of the U-channel allows it to simulate the balance cover. This integration of the balance and the balance cover allows a single piece to be installed at a lower cost to the window manufacturer.

The invention described herein is advantageous because it is efficient and inexpensive compared to other approaches for the construction of window sash balances. The improved design makes it unnecessary to have a single balance for each of a plurality of window sash heights. In addition, it allows the pre-assembly of a portion of the balance (pulley & cord) so as to reduce the complexity of the final assembly process. The techniques of the invention are advantageous because they provide a range of alternative balance sizes constructed in a similar fashion, each of which is useful in appropriate situations. As a result of the invention, the cost to manufacture and install window sash balances will be reduced from conventional balance designs.

Figure 1:
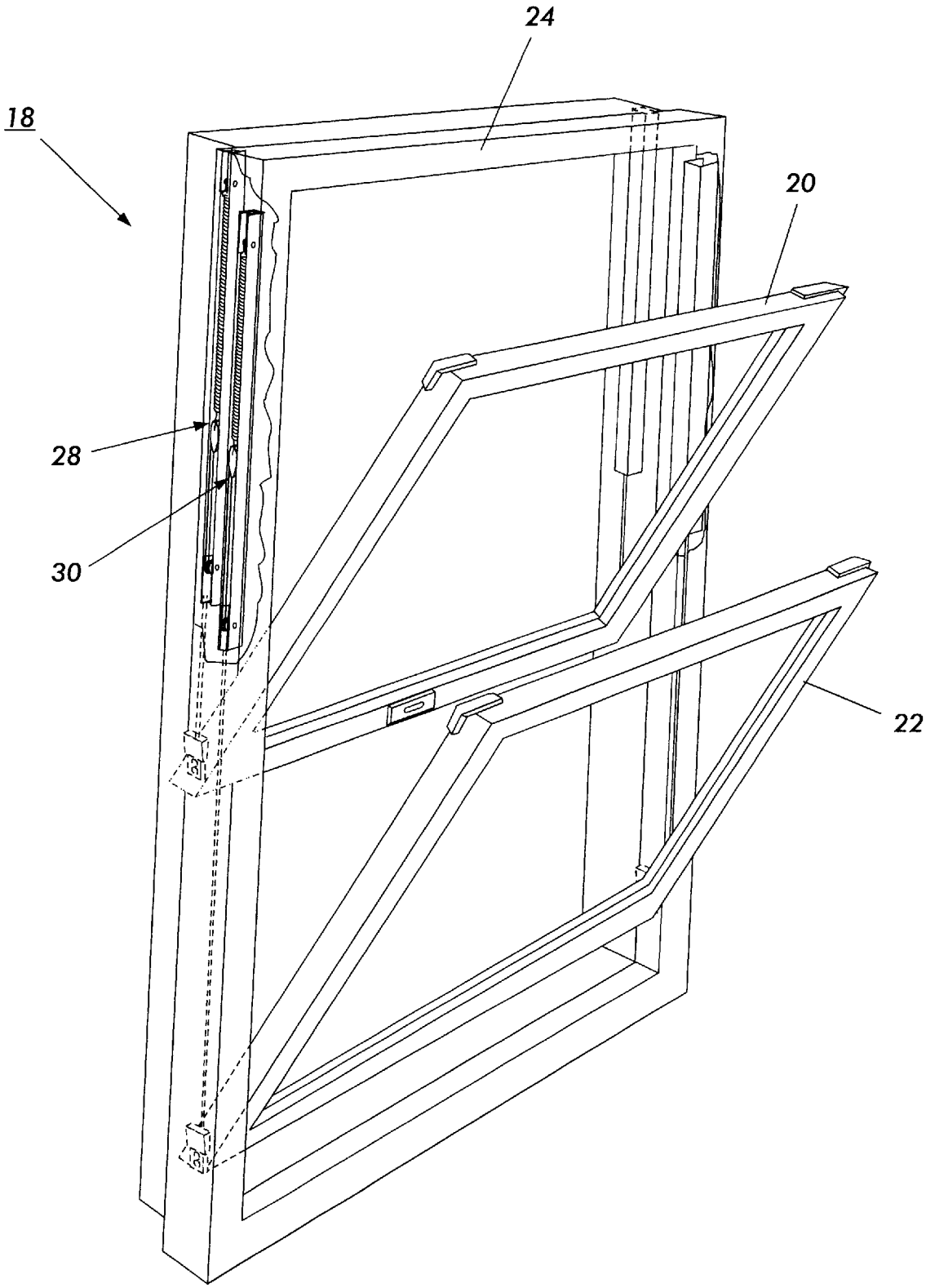
FIG. 1 is an illustration of an exemplary double-sash window that provides an exemplary embodiment for the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements.

Referring now to FIG. 1, there is displayed an exemplary illustration of a sash window unit 18 including an upper window sash 20 and a lower window sash. 22 located within a frame 24. A user raising or lowering the sashes controls the vertical position of the upper and lower sashes. However, due to the weight of the sashes, they must be counterbalanced using counter balances (or balances) 28 and 30 (and associated balances on the opposite side of the frame). It will be further appreciated that one or more of the aspects described with respect to the embodiment of FIG. 1 may also be applicable to a jamb liner.

Figure 5:
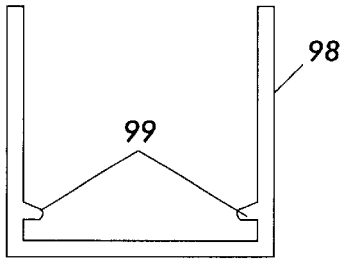
Figure 6:
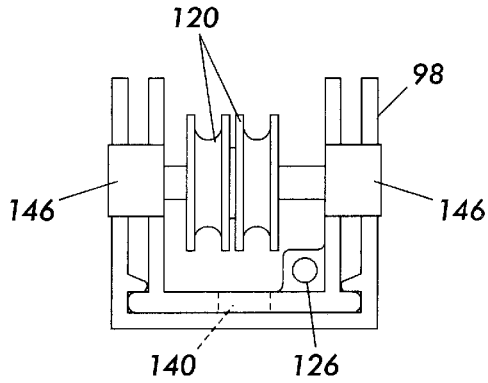

In accordance with the present invention, the balances 28 and 30 are, preferably comprised of a U-shaped channel 98 that is preferably extruded from a semi-rigid material, although it is also possible to use a rigid material including metal and aluminum with aspects of the present invention. As depicted in FIG. 5, illustrating a cross-section of channel 98, the channel preferably includes a pair of opposed ridges 99. As will be described below, the ridges serve to retain elements placed therein during assembly. In a preferred embodiment, the material employed for the channel is a compound including vinyl, such as various plastics that are easily polymerized and produce extrusions that are tough, and flexible so as to produce a channel that is easily extruded and costs a fraction of the cost of the metal channel used in prior art balance systems. An extruded vinyl part produced in accordance with an aspect of the present invention has the advantage of being less expensive, more corrosion resistant and more esthetically pleasing than a rigid metal channel as it can be extruded in various colors to match any wood, metal or vinyl profile. Moreover, the vinyl may be produced with a smooth or textured outer surface so as to, along with coloring, result in the look of wood, and avoid the need for painting or other corrosion resistant coatings.

In accordance with the present invention, U-shaped channel 98 of the balance assembly 28, 30 is used to transport the actual assembly to the customer's facility. The channel 98 also acts as a guide for the block and tackle pulley assembly 102 and spring 104 to move in the appropriate direction and keeps the complete system concealed and out of interference with other components in the window.

Figure 2:
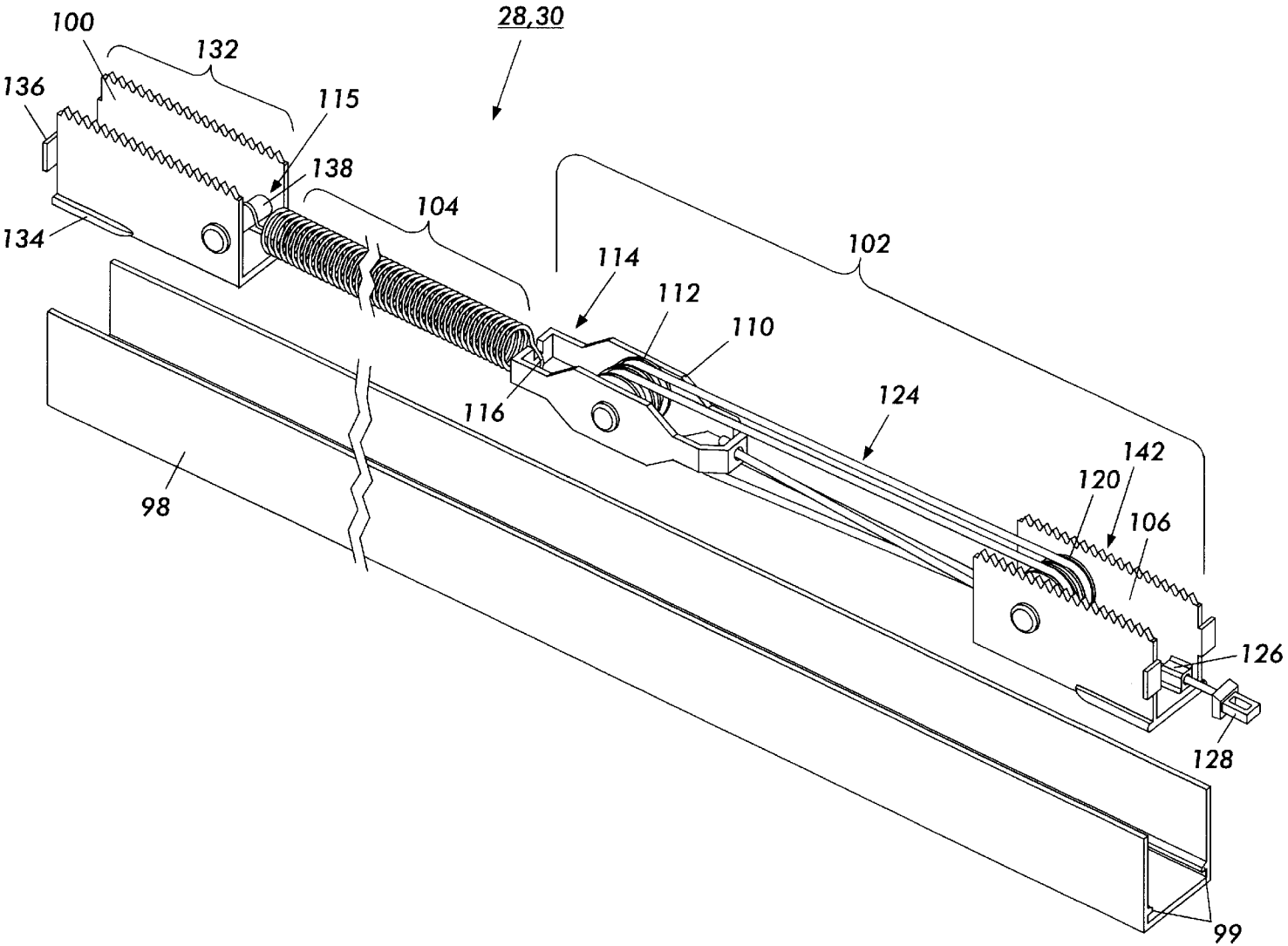
FIG. 2 is an illustration depicting the assembly of the various components of an embodiment of the present invention.

Balance assemblies 28 and 30 each preferably consist of a top shoe 100, a pulley assembly 102, a spring 104 and a bottom shoe 106. As depicted in FIG. 2, the pulley assembly 102 includes a middle pulley block 110 containing one or more pulleys 112, a top end fastening means 114 for fastening the block 110 to the lower end of the spring 104. Preferably the fastening means 114 includes a hole or hook to receive a hook 116 on the lower end of spring 104. Pulley assembly 102 also includes at least one pulley 120 located within an upper end of bottom shoe 106. Completing the pulley assembly is cord 124 which is connected on one end to the middle pulley block 110 (or alternatively to the bottom shoe) and then threaded around the pulleys 112 and 120 before the other end passes out of the bottom end of bottom shoe 106 at location 126 before terminating in a hook or post 128.

Each of the pulley blocks 110 and the top and bottom shoes 100 and 106 may be made of a metal alloy or high strength thermoplastics, using die casting or plastic injection molding processes. The components preferably are able to accommodate the stresses applied to them by the spring and pulley assembly during installation and operation.

Figure 3:
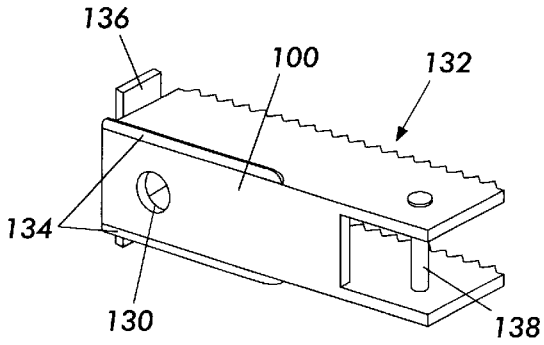
FIGS. 3–6 are alternative views of aspects of the components in FIG. 2.
Figure 4:
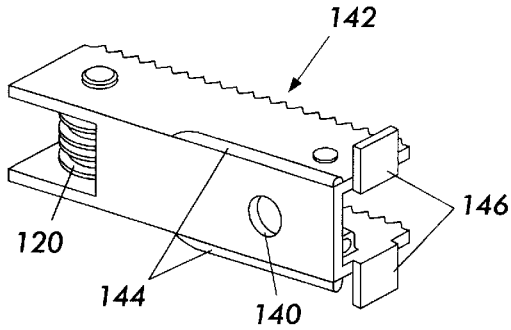

As depicted in FIGS. 3 and 4, the top shoe 100 and bottom shoe 106 are each molded or constructed to include a mounting screw hole 130 and 140, respectively. In accordance with one aspect of the invention, the mounting holes are provided so that the respective top and bottom shoes may be affixed to the side of a window frame or jamb liner. As intended by the design of the present invention, affixing the top shoe and bottom shoe to the rigid frame of the window, provides two points of rigidity required for the balance to function in full capacity as a block and tackle balance. In other words, the present invention utilizes the inherent rigidity of the window frame or jamb liner to which the top and bottom shoes are attached, and not of the U-shaped channel, to maintain the spacing of the shoes. The window frames are very rigid and can absorb such stress without risk of failure. In order to further assure a tight bond to the window frame, particularly when wood frames are employed, the top and bottom shoes preferably include along outer edges thereof, teeth or similar saw-toothed surfaces 132 and 142 that grip into the window frame and increase the friction between the frame and the shoes—thereby giving the assembly further strength and unity with the frame. The inclusion of mounting holes 130 and 140 in the respective shoes eliminates the need for a mounting bracket as is currently used in many prior art balance systems that rely on a metal channel to give the mounting strength. Hence, the present invention reduces labor, material, tooling and inventory costs in comparison with the prior art balance assemblies.

Because the U-shaped channel 98 is preferably made of a semi-rigid material, it is not suitable for carrying the spring with any significant initial tension or pre-load. While dependent upon the rigidity of the U-shaped extrusion 98, it is believed that a spring pre-load of significantly more than 1.0 lbs. pull force may cause the complete assembly to deform or buckle the channel 98 and collapse. Therefore the spring is shipped with the spring in a relaxed position with just enough tightness (and preferably less than 0.25 lbs. spring pull force) to keep the complete balance assembly together for transportation without collapsing.

The initial stretch on the spring is achieved when the balance is installed and the cord is pulled to engage it to the sash. The length of the balance is kept smaller than that of the sash length. As the balance is smaller than the sash size the spring will be in a stretched position even in its most relaxed position. This slight pull will put the spring into the initial stretch that is required to keep the spring in the working range for that particular sash weight and size. This reduces cost in material and allows the balance to carry the same weight for various sash sizes. Now one balance can be used for multiple size balances reducing inventory for manufacture and for customers.

In smaller balances or in balances requiring special weight carrying capabilities or when springs are not available for a particular size balance, it might be required to send the block and tackle and the spring separate from the semi-rigid cover. The top of the block and tackle assembly will be first mounted on the window. As described below, a simple rigid metal U-shaped channel or similar tool will then be used to stretch the spring to the required initial stretch and fasten the lower pulley housing to the window. The tool will then be removed and a semi-rigid cover can cover the balance.

The top shoe and bottom pulley housing are designed with flanges at the end to keep the shoes from moving into the vinyl channel. There is also a ridge guide at the bottom to assure that the shoes will not slip but of the vinyl channel and the vinyl channel carries a mating grove running the length of the channel. This assembly method eliminates the need for any riveting. It speeds up assembly. The modular design allows the block and tackle assembly to be threaded where it is most economical and labor costs are low. The reduction in the number of sizes required for manufacturing allows this procedure to be out sourced thereby reducing overall costs.

Referring to FIGS. 2–6, the manner of assembling the balances 28 and 30 will be described in accordance with an embodiment of the present invention. Initially, top shoe 100 is inserted within an upper end of semi-rigid channel 98 as seen in FIG. 2. Assembly is aided by the ridges 99 running on either side of the channel, the ridges preferably mating with grooves (not shown) or ridges 134 on the outside of shoe 100. Thus top shoe 100 is slidably inserted into the channel where it will come to rest when a flange 136 on the upper edge of the top shoe comes into contact with the end of the channel and causes it to stop. The hook 116 at the lower end of the spring is then connected to the middle pulley housing 110 using a hole or other connection in the top of the middle pulley housing. Subsequently, the middle pulley housing is connected to the bottom pulley and the bottom shoe by threading cords 124 therethrough. In a preferred embodiment, cords 124 are made of a polyester or Dacron material suitable for use in the window balance embodiment. As previously noted, one, end of the cord is tied or otherwise connected (e.g., cord passed through a hole and knotted, crimped, etc.) to either the lower end of the middle pulley 110 or to the top end of the bottom shoe (depending upon the pulley arrangement). The other end of the cord 124 is threaded through a cord guide 126 in the bottom shoe and exits out of the balance assembly where it is attached or terminated at a hook, post or similar terminating attachment 128. The cord guide is employed so that. the cord does not come in contact with the mounting screw while in use, and is tied to a terminating attachment 128. One the pulley assembly is completed, the bottom shoe also slides into the semi-rigid channel with its mating ridges 144 and stopping flanges 146. The bottom pulley assembly again comes to a stop once the flanges 146 come in contact with the lower ends of the channel walls. It will be appreciated that alternative means may be employed to limit the travel of the shoes within the rigid channel, including tabs on an interior wall of the channel, or even the use of an adhesive or thermo-staking of the channel to the shoe once assembled. Lastly, hook 115 at the upper end of spring 104 is looped around a pin or equivalent attachment mechanism 138 on the top shoe. The pin is preferably integrally molded with top shoe 100. Hooking of the spring places the spring in a slight tension in order to retain the top and bottom shoes within the channel 98.

With minimum tension on the top shoe and bottom shoe, the complete assembly stays intact without the need for any rivets. Accordingly, the assembly can very easily be assembled by hand with very little labor or effort. Although described with the series of steps indicated above, it will be appreciated that the sequence of said steps might be altered so as to accomplish one or more steps (e.g., threading the pulley assembly) independently.

Figure 7:
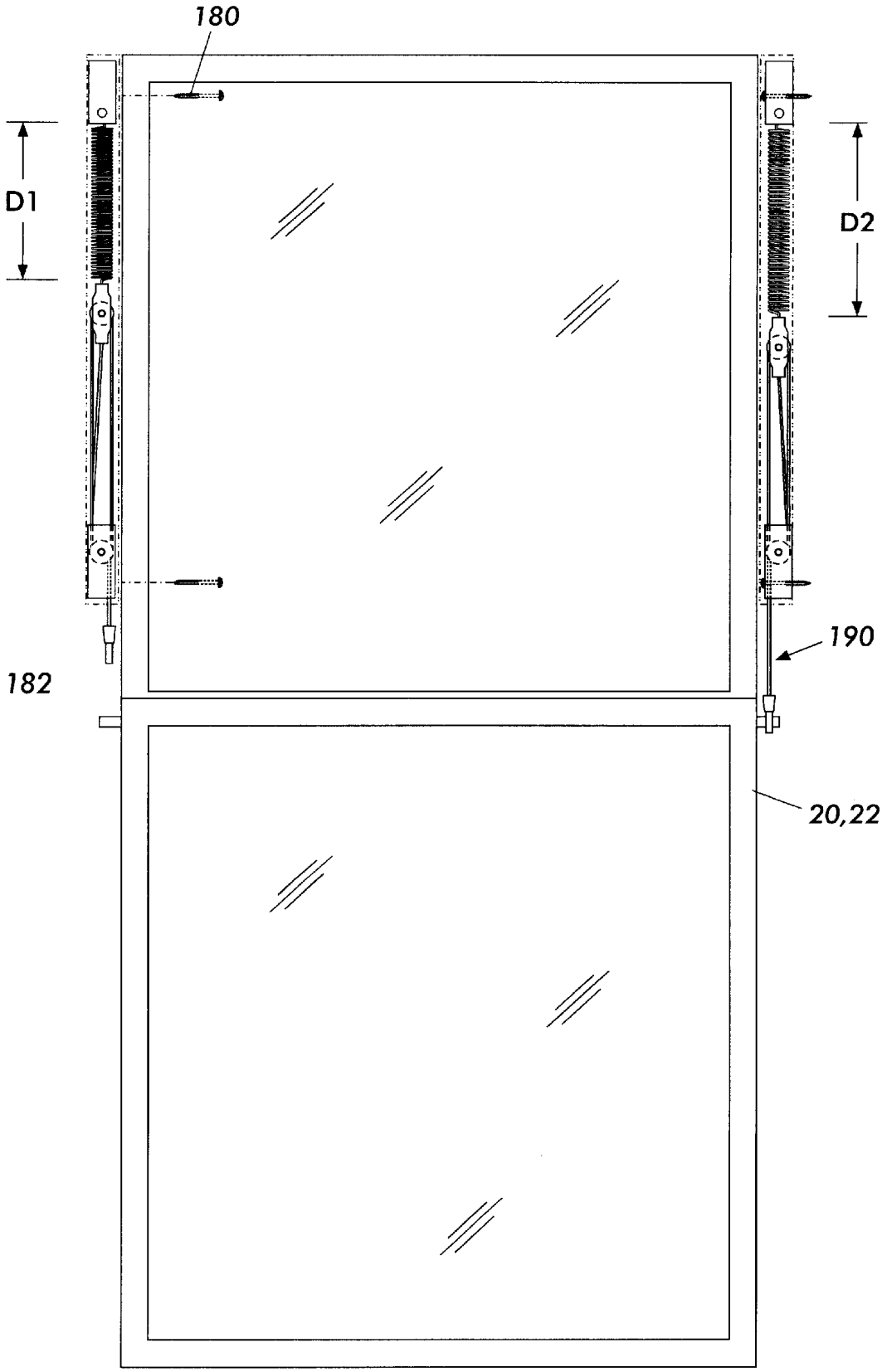
FIGS. 7 and 8 depict alternative installation methods for balances used in accordance with the present invention.

Referring next to FIG. 7, there is depicted a preferred installation of a balance in accordance with the present invention. Once the balance is assembled, the top shoe is preferably affixed to the window frame using a screw 180, and then the bottom shoe is affixed to the window frame at apposition below the top shoe using screw 182, wherein the spring is placed in slight tension (distance D1). These mounting screws also hold the semi-rigid housing in place over the complete assembly. Once the top and bottom shoes are attached to the frame, the lo terminating hook is withdrawn from the assembly (as indicated by arrow 190) and attached to the outer, lower edge of sash 20 or 22, bringing the spring to an elongated position (distance D2).

Figure 8:
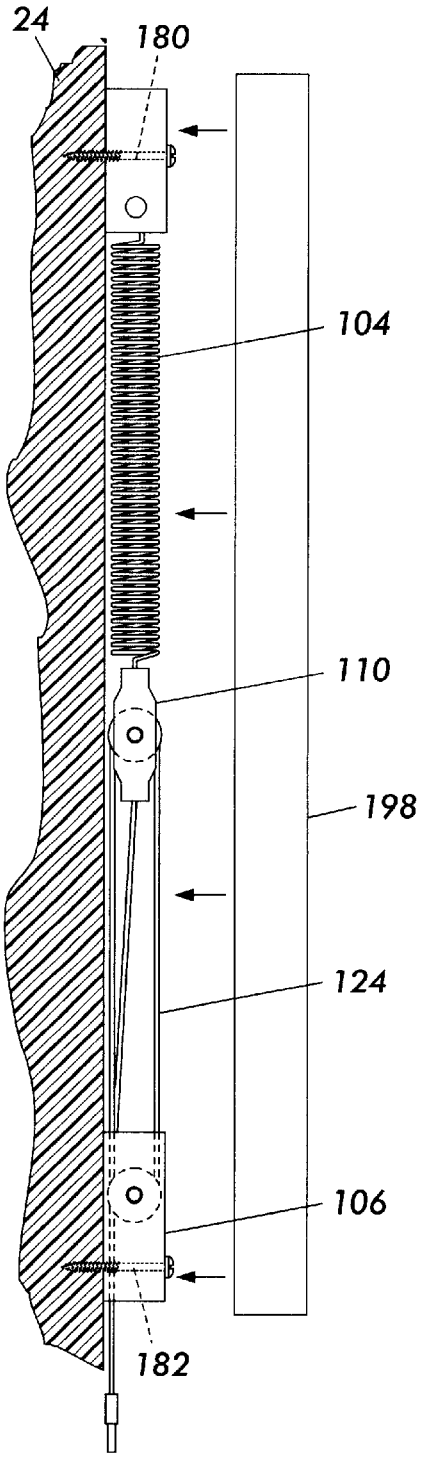

As depicted in alternative embodiment of FIG. 8, the upper and lower shoes (100, 106), spring 104 and pulley assembly 102 may also be directly mounted to the window frame 24, and a U-shaped cover 198 placed thereover. Cover 198 preferably conceals the shoes and balance hardware once it is placed over the balance assembly, wherein the cover is attached to the top and bottom shoes. As depicted in FIG. 8, the balance is installed using mounting screws 180 and 182, respectively passing through the top shoe and the bottom shoe into the frame. Subsequently, vinyl cover 198 is affixed to cover the balance assembly using the top and bottom shoes.

In yet another alternative method of installation, the top shoe 100 is mounted onto the window frame or jamb liner using a mounting screw 180 without the semi-rigid channel. Then the bottom shoe, and associated pulley assembly and spring, is stretched using a rigid U-channel (not shown) that engages the flanges 136 and 146 on the shoes, thereby providing a pre-determined initial stretch. The bottom shoe is then mounted onto the window frame using mounting screw 182. After the balance assembly has been installed the rigid U-channel is removed and a semi-rigid cover 198 can then be snapped into place to cover the block and tackle and spring mechanism. It will be appreciated that the grooves or ridges 134 and 144 may be employed in this embodiment to provide a surface to which the semi-rigid channel may attach. This embodiment is believed to be very cost effective for jamb liners, where jamb liners are vinyl extrusions that already have balances installed in them and are put in wood or metal windows. However due to this embodiment jamb liners do not require any metal or semi-rigid cover and can be incorporated into the vinyl extrusion.

Figure 9:
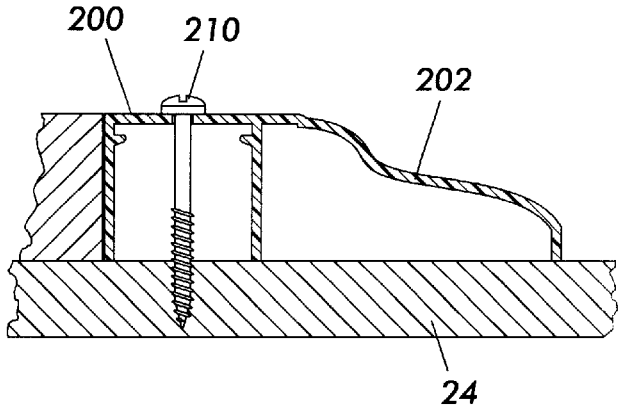
FIGS. 9, 10 and 11 illustrate an extruded balance cover incorporated with the semi-rigid channel depicted in the embodiment of FIG. 2.
Figure 10:
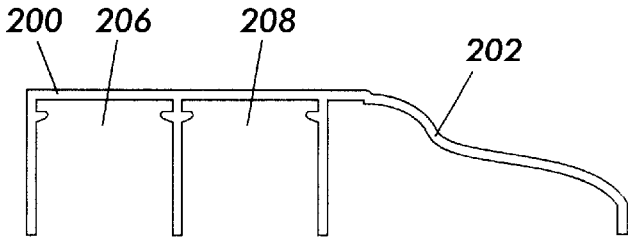

Referring next to FIG. 9, there is depicted a cross-section of an extruded semi-rigid channel (or cover) that 200 is co-extruded complete with a balance cover 202. As depicted in FIG. 10, the cover 200 may include a pair of U-shaped channels 206 and 208 along with balance cover 202. As previously described the cover 200 is snapped into place in the socket provided on the shoes or in the window frame (not shown) with a mounting screw 210 mounting the assembly to the frame and keeping it in place.

Figure 11:
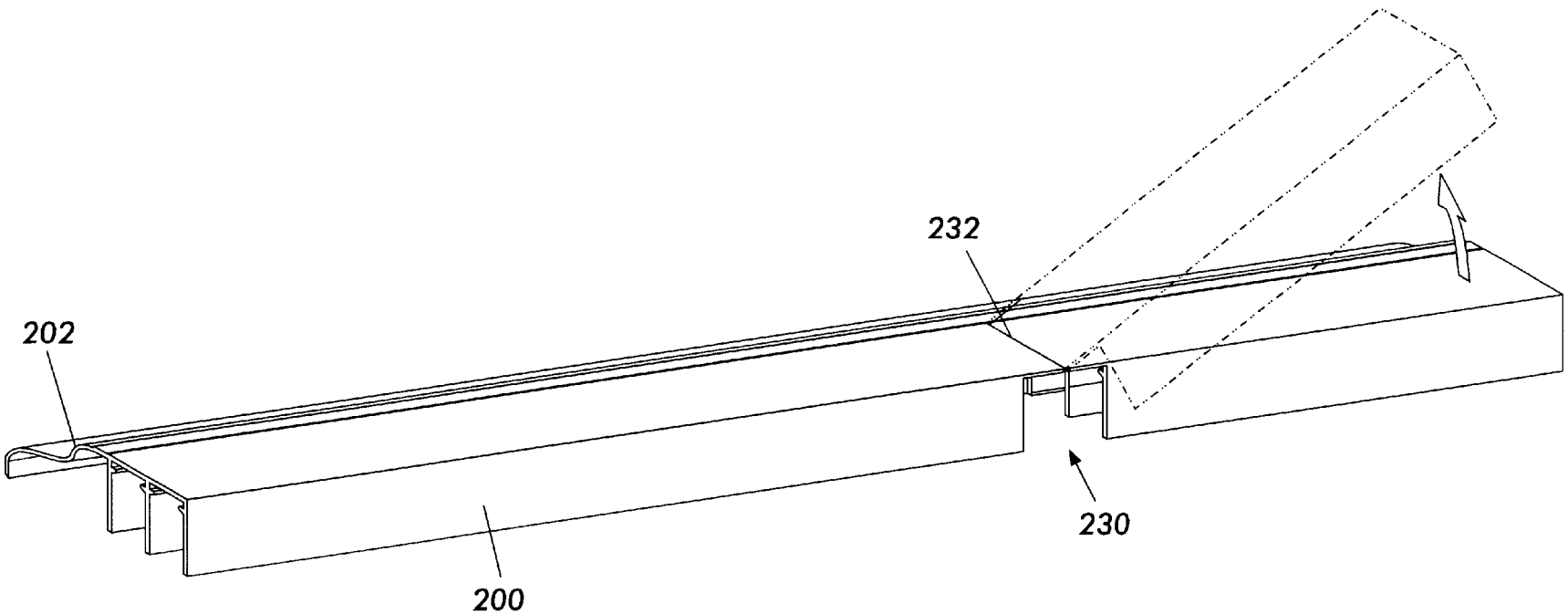

The embodiment illustrated in FIG. 11 is that of a semi-rigid U-shaped housing or cover (such as described with respect to FIG. 10) that is to be used as a balance cover and is required to be long enough to cover the pocket extruded in the window frame and accommodate the counter balance system of the present invention. In the embodiment depicted, the U-shaped channel 200 in the extrusion is cut at point 230 to allow for the balance size required. This allows the balance to have longer covers than the balance itself. Due to the slot the extrusion is weak enough to bend. However a small indentation can be made at location 232 to allow the bottom, unused portion of the extrusion to be bent as shown in the figure, in order to make the cord (or termination hook) accessible.

Figure 12:
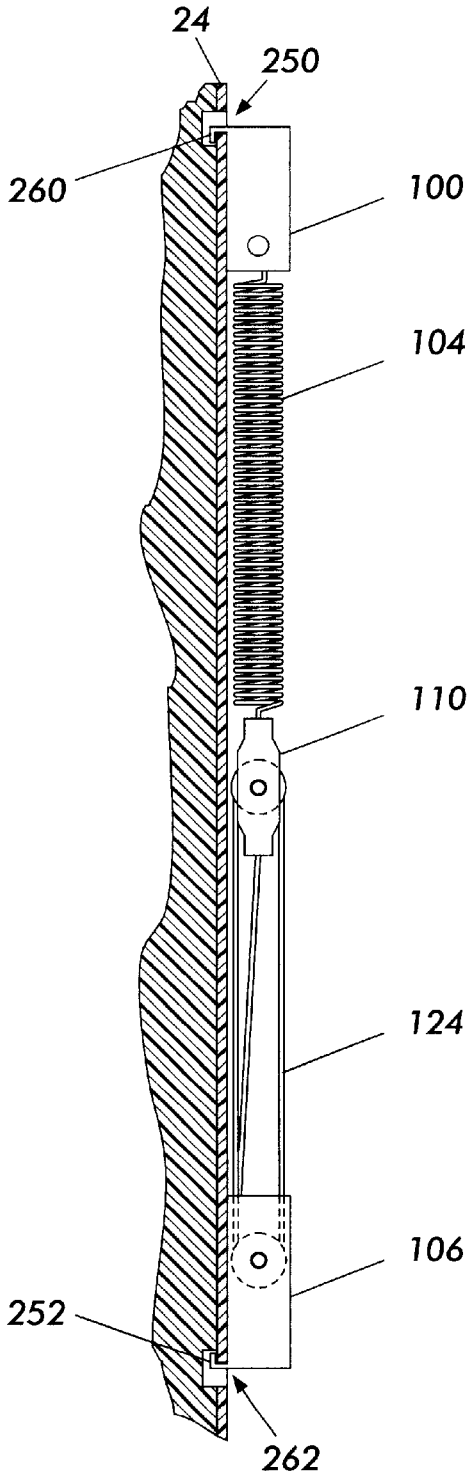
FIG. 12 is an illustration of an alternative embodiment of the top and bottom shoes depicted in FIG. 2.
Figure 13:
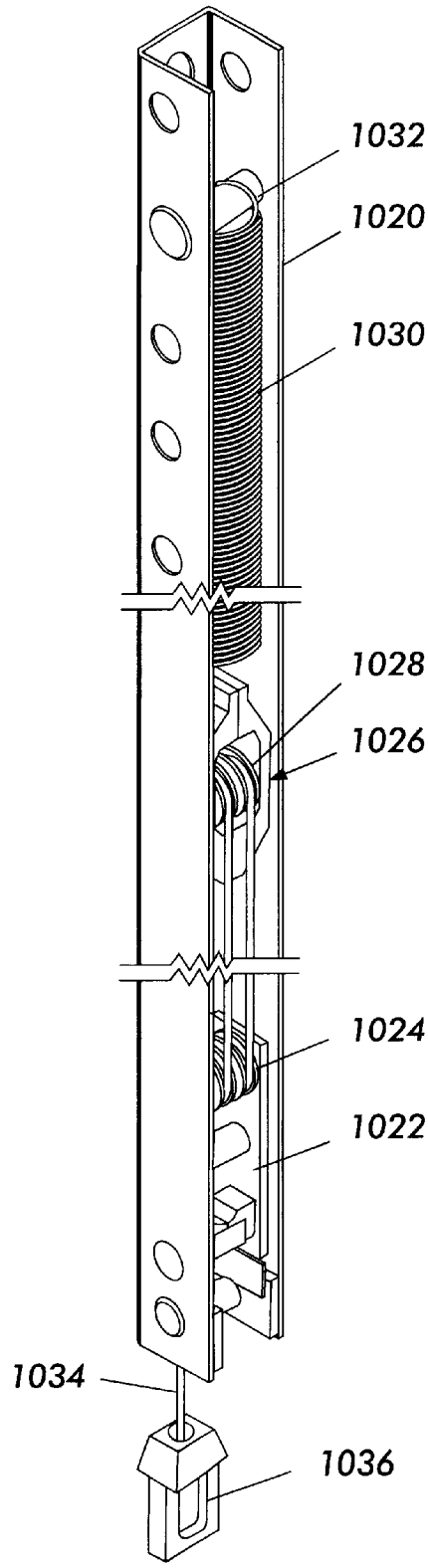
FIG. 13 PRIOR ART
FIG. 13 is an illustration of a Prior Art balance.

In yet another alternative embodiment for the present invention, illustrated in FIG. 12, the top and bottom shoes include means for attaching the shoes to the frame. In one embodiment, the attachment means includes a hook 260 extending from a shoe surface adjacent the window frame, and a corresponding slot, hole or other suitable receiving means 250 into which the hook can be inserted within the window frame to secure the top shoe to the frame. Similarly, the bottom shoe 106 also includes a hook 252 that is engaged with the hole or receiving means 262 on the frame 24.

In recapitulation, the present invention is an apparatus and method of assembling a block and tackle counter balance for windows that reduces the cost of manufacture and installation. In particular, the balance provides vertical support to a window sash using a semi-rigid channel, a top shoe for insertion into one end of the semi-rigid channel, and a bottom shoe for insertion into another end of the semi-rigid channel. Connected to the top shoe is a spring, and a block and tackle pulley assembly is connected between the bottom end of the spring and the bottom shoe, wherein a cord from the pulley assembly extends outward from the bottom shoe for connection to the window sash.

It is, therefore, apparent that there has been provided, in accordance with the present invention, a method and apparatus for sash counter balances in windows. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I Claim:

1. A balance assembly for providing vertical support to a window sash, comprising:

a channel;

a top shoe for insertion into one end of the channel;

a bottom shoe for insertion into another end of the channel;

a spring connected to a bottom end of the top shoe; and a block and tackle pulley assembly connected between a bottom end of the spring and the bottom shoe, wherein a cord from the pulley assembly extends outward from the bottom shoe for connection to the window sash.

2. The balance assembly of claim 1, wherein the channel is a semi-rigid channel.

3. The balance assembly of claim 2, wherein the semi-rigid channel is produced by extrusion.

4. The balance assembly of claim 3, wherein the semi-rigid channel is made from a thermoplastic.

5. The balance assembly of claim 4, wherein the thermoplastic is a vinyl compound.

6. The balance assembly of claim 1, wherein the channel is U-shaped.

7. The balance assembly of claim 1, wherein the channel includes a pair of opposed ridges in the sidewalls thereof for receiving mating ridges on the top and bottom shoes, so as to position the top and bottom shoes within the respective ends of the channel.

8. The balance assembly of claim 1, wherein the top shoe includes:

a pin for hooking an upper end of the spring; and a mounting hole for receiving a screw to affix the top shoe to a window frame in which the window sash slides.

9. The balance assembly of claim 8, wherein the top shoe, further includes at least one stopping flange along an upper edge thereof to prevent the upper edge of the top shoe from sliding into the channel when the top shoe is inserted therein.

10. The balance assembly of claim 8, wherein the-top shoe, including the pin, is made from a material selected from the group consisting of:

an injection-molded thermoplastic;

a die-cast metal alloy; and a stamped metal.

11. The balance assembly of claim 8, wherein the top shoe further includes teeth along at least a portion of an exposed edge thereof, wherein said teeth increase the frictional force between the top shoe and the window frame when the exposed edge is adjacent the window frame and affixed thereto.

12. The balance assembly of claim 8, wherein the top shoe further includes a hook extending from a surface adjacent the window frame, wherein said hook can be inserted into a hook receiving means within the window frame to secure the top shoe to the frame.

13. The balance assembly of claim 1, wherein the bottom shoe includes:

a mounting hole for receiving a screw to affix the bottom shoe to a window frame in which the window sash slides;

opposed mounting holes for receiving an axle of a lower pulley of the pulley assembly; and a cord guide to divert the cord so as to avoid contact with the screw used to affix the bottom shoe to the window frame.

14. The balance assembly of claim 13, wherein the bottom shoe includes at least one stopping flange along a lower edge thereof to prevent the lower edge of the bottom shoe from sliding into the channel when the bottom shoe is inserted therein.

15. The balance assembly of claim 13, wherein the bottom shoe is made from a material selected from the group consisting of:

an injection-molded thermoplastic;

a die-cast metal alloy; and a stamped metal.

16. The balance assembly of claim 11, wherein the bottom shoe further includes teeth along at least a portion of an exposed edge thereof, wherein said teeth increase the frictional force between the bottom shoe and the window frame when the exposed edge is adjacent the window frame and affixed thereto.

17. The balance assembly of claim 13, wherein the bottom shoe further includes a hook extending from a surface adjacent the window frame, wherein said hook can be inserted into a hook receiving means within the window frame to secure the bottom shoe to the frame.

18. The balance assembly; of claim 1, wherein the relative length of the channel, the pulley assembly and the spring are such that the spring is maintained in slight extension and produces a compressive force applied to the channel of less than 1.0 lbs. force.

19. A balance assembly for providing vertical support to a window sash, comprising:

a semi-rigid extrusion having at least a pair of U-shaped channels therein, each of said channels, including a top shoe for insertion into one end of the semi-rigid channel, a bottom shoe for insertion into another end of the semi-rigid channel, a spring connected at a top end to the top shoe, and a block and tackle pulley assembly connected between a bottom end of the spring and the bottom shoe, wherein a cord from the pulley assembly extends outward from the bottom shoe for connection to the window sash.

20. A balance assembly for providing vertical support to a window sash, comprising:

a top shoe;

a bottom shoe;

a spring connected to a bottom end of the top shoe;

a block and tackle pulley assembly connected between a bottom end of the spring and the bottom shoe, wherein a cord from the pulley assembly extends outward from the bottom shoe for connection to the window sash; and a balance cover, removably attached to said top and bottom shoes to provide a cover for the spring and pulley assembly.

21. The balance assembly of claim 20, wherein the balance cover further comprises an extruded plastic material, and where the balance cover has a portion thereof that is hinged so as to allow access to the cord from the pulley assembly for connection to the window sash.

22. A method for installing a balance assembly on a window frame to provide vertical support to a window sash, comprising:

connecting, in series, a top shoe, a spring connected to a bottom end of the top shoe, a block and tackle pulley assembly connected to a bottom end of the spring, and a bottom shoe that retains a bottom pulley of the block and tackle pulley assembly, wherein a cord from the pulley assembly extends downward from the bottom shoe for connection to the window sash;

affixing the top shoe to the window frame;

affixing the bottom shoe to the window frame at a position below the top shoe, wherein the spring is placed in tension; and placing a cover over the balance assembly, wherein the cover is attached to the top and bottom shoes.

23. The method of claim 22, wherein the distance between the top shoe and the bottom shoe is controlled in accordance with the height of the window sash.

24. The method of claim 23, wherein the distance between the top shoe and the bottom shoe is determined by a channel retaining the balance assembly.

25. The method of claim 22, wherein the distance between the top shoe and the bottom, shoe is controlled in accordance with the desired tension on the spring.

26. A bottom shoe for use in a balance assembly for counterbalancing a window sash in a frame, comprising:

a block having a mounting hole for receiving a screw to affix the bottom shoe to the window frame in which the window sash slides;

opposed mounting holes for receiving an axle of a lower pulley of a pulley assembly; and a cord guide to divert a cord so as to avoid contact with the screw used to affix the bottom shoe to the window frame.

* * * * *